US011353249B2

(12) United States Patent
Yan et al.

(10) Patent No.: US 11,353,249 B2
(45) Date of Patent: Jun. 7, 2022

(54) TWO-PIPE ENHANCED-VAPOR-INJECTION OUTDOOR UNIT AND MULTI-SPLIT SYSTEM

(71) Applicants: HEFEI MIDEA HEATING & VENTILATING EQUIPMENT CO., LTD., Hefei (CN); GD MIDEA HEATING & VENTILATING EQUIPMENT CO., LTD., Foshan (CN)

(72) Inventors: Libo Yan, Hefei (CN); Guozhong Yang, Hefei (CN); Mingren Wang, Hefei (CN); Zhijun Tan, Hefei (CN); Sanguo Peng, Hefei (CN)

( * ) Notice: Subject to any disclaimer, the term of this patent is extended or adjusted under 35 U.S.C. 154(b) by 202 days.

(21) Appl. No.: 16/621,256

(22) PCT Filed: Jun. 3, 2019

(86) PCT No.: PCT/CN2019/089859
§ 371 (c)(1),
(2) Date: Dec. 11, 2019

(87) PCT Pub. No.: WO2020/082740
PCT Pub. Date: Apr. 30, 2020

(65) Prior Publication Data

US 2021/0293459 A1 Sep. 23, 2021

(30) Foreign Application Priority Data

Oct. 22, 2018 (CN) ..... 201811227641.5

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01); *F25B 2313/027* (2013.01)

(58) Field of Classification Search
CPC .. F25B 43/006; F25B 13/00; F25B 2313/023; F25B 2313/0233; F25B 40/00;
(Continued)

(56) References Cited

U.S. PATENT DOCUMENTS 8,806,888 B2 * 8/2014 Ko ..... F25B 43/00 62/510
9,958,189 B2 * 5/2018 Ryu ..... F25B 1/04
(Continued)

FOREIGN PATENT DOCUMENTS

CN 105008820 A 10/2015
CN 105240957 A 1/2016
(Continued)

OTHER PUBLICATIONS

The first Office Action dated Dec. 6, 2019 in the corresponding CN application No. 201811227641.5.
OA for CA application 3,066,275.

*Primary Examiner* — Joseph F Trpisovsky
(74) *Attorney, Agent, or Firm* — Kilpatrick Townsend & Stockton, LLP

(57) ABSTRACT

A two-pipe enhanced-vapor-injection outdoor unit and a two-pipe enhanced-vapor-injection multi-split system are provided. The two-pipe enhanced-vapor-injection outdoor unit includes an outdoor heat exchanger, an enhanced-vapor-injection compressor, a reversing assembly, a super cooler, a throttling assembly and a first pipe. The reversing assembly includes a first end and a second end connected with a gas discharge port and a gas return port, respectively. A main heat-exchange flow path is connected with the first port and the second port, respectively. An auxiliary heat-exchange flow path is connected with the injection port. The throttling assembly includes two ends connected with an outlet of the main heat-exchange flow path and an inlet of the outdoor heat exchanger. The first pipe includes a first end connected
(Continued)

with an outlet of the outdoor heat exchanger, and a second end arranged between the throttling assembly and the main heat-exchange flow path.

12 Claims, 7 Drawing Sheets

(58) Field of Classification Search
CPC ..... F25B 40/02; F25B 2400/13; F25B 2600/2509; F25B 2400/0409; F25B 2400/0411
See application file for complete search history.

(56) References Cited

U.S. PATENT DOCUMENTS

| | | | | |
|---|---|---|---|---|
| 10,508,848 | B2 * | 12/2019 | Saikusa | F25B 41/31 |
| 2013/0019624 | A1 | 1/2013 | Tamaki et al. | |
| 2014/0305144 | A1 * | 10/2014 | Kim | F25B 13/00 62/79 |
| 2014/0360218 | A1 * | 12/2014 | Takenaka | F25B 13/00 62/324.6 |
| 2016/0097568 | A1 * | 4/2016 | Korenaga | F25B 49/02 62/160 |
| 2016/0273816 | A1 * | 9/2016 | Horiuchi | F25B 47/025 |
| 2017/0268791 | A1 | 9/2017 | Luo et al. | |
| 2018/0306473 | A1 * | 10/2018 | Wei | F25B 41/20 |
| 2018/0356136 | A1 * | 12/2018 | Zhao | F25B 41/31 |
| 2019/0049155 | A1 * | 2/2019 | Tanaka | F25B 13/00 |
| 2019/0137153 | A1 * | 5/2019 | Yang | F25B 49/022 |

FOREIGN PATENT DOCUMENTS

| | | | | | |
|---|---|---|---|---|---|
| CN | 105258393 | A | * | 1/2016 | F25B 13/00 |
| CN | 105605816 | A | | 5/2016 | |
| CN | 106765617 | A | | 5/2017 | |
| CN | 109386985 | A | | 2/2019 | |
| EP | 2843323 | A | | 3/2015 | |
| JP | 2009198099 | A | | 9/2009 | |
| JP | 2015059719 | A | | 3/2015 | |

* cited by examiner

TWO-PIPE ENHANCED-VAPOR-INJECTION OUTDOOR UNIT AND MULTI-SPLIT SYSTEM

CROSS-REFERENCES TO RELATED APPLICATIONS

The present disclosure is a national phase application of International Application No. PCT/CN2019/089859, filed on Jun. 3, 2019, which claims the priority of Chinese Application No. 201811227641.5, filed in the Chinese Patent Office on Oct. 22, 2018, the entireties of which are herein incorporated by reference.

FIELD

The present disclosure relates to the field of air conditioners, and particularly to a two-pipe enhanced-vapor-injection outdoor unit and a two-pipe enhanced-vapor-injection multi-split system.

BACKGROUND

Currently, the conventional enhanced vapor injection and low-temperature forced heat change technologies are only used in the heat pump and the three-pipe heat recovery system. Since the gas return pipe of the outdoor unit in the two-pipe system just has the low pressure, it is difficult to achieve the enhanced vapor injection at the injection port of the compressor. Thus, the two-pipe multi-split system has the low pressure at the low-pressure side, the low density of the returned gas, and the small refrigerant circulation, and hence has the problem of insufficient heating capacity in the low-temperature environment, due to the low environment temperature. Moreover, the two-pipe system has problems of the high exhaust superheat degree and the insufficient heating capacity in the high-pressure environment.

SUMMARY

One embodiment of the present disclosure provides a two-pipe enhanced-vapor-injection outdoor unit.

Another embodiment of the present disclosure provides a two-pipe enhanced-vapor-injection multi-split system.

In view of the above, the present disclosure provides a two-pipe enhanced-vapor-injection outdoor unit. The two-pipe enhanced-vapor-injection outdoor unit includes: an outdoor heat exchanger, a first port and a second port, the first end being communicated with one of the third end and the fourth end, and the second end being communicated with the other one of the third end and the fourth end; an enhanced-vapor-injection compressor having a gas discharge port, a gas return port and an injection port; a reversing assembly including first to fourth ends, the first end of the reversing assembly being connected with the gas discharge port, the second end of the reversing assembly being connected with the gas return port; a super cooler including a main heat-exchange flow path and an auxiliary heat-exchange flow path communicated with each other, the main heat-exchange flow path being connected with the first port and the second port, respectively, and the auxiliary heat-exchange flow path being connected with the injection port; a throttling assembly including a first end connected with an outlet of the main heat-exchange flow path, and a second end connected with an inlet of the outdoor heat exchanger; and a first pipe including a first end connected with an outlet of the outdoor heat exchanger, and a second end arranged between the throttling assembly and the main heat-exchange flow path.

The two-pipe enhanced-vapor-injection outdoor unit provided by the present disclosure includes the outdoor heat exchanger, the enhanced-vapor-injection compressor, the reversing assembly, the super cooler, the throttling assembly and the first pipe. The first end of the reversing assembly is connected with the gas discharge port, and the second end of the reversing assembly is connected with the gas return port. The main heat-exchange flow path of the super cooler is communicated with the auxiliary heat-exchange flow path of the super cooler. The main heat-exchange flow path is connected with the first port and the second port, respectively. The auxiliary heat-exchange flow path is connected with the injection port. The first end of the throttling assembly is connected with the outlet of the main heat-exchange flow path, and the second end of the throttling assembly is connected with the inlet of the outdoor heat exchanger. The first end of the first pipe is connected with the outlet of the outdoor heat exchanger, and the second end of the first pipe is arranged between the throttling assembly and the main heat-exchange flow path. In the present disclosure, by using the enhanced-vapor-injection compressor, the gaseous refrigerant flowing out of the enhanced-vapor-injection heat exchanger directly enters the compressor through the middle injection port for the enhanced-vapor-injection compression. Moreover, the super cooler and the throttling assembly are added to significantly increase a refrigerant circulation in a heating operation at a low temperature, and a range of the heating operation at the low temperature is expanded in the two-pipe enhanced-vapor-injection outdoor unit, and also the heating capacity is improved significantly. In addition, the first pipe is added, and the super cooler can improve a super cooling degree at the outlet of the outdoor heat exchanger, to reduce an exhaust superheat degree, and improve the heating capacity at a high temperature.

The two-pipe enhanced-vapor-injection outdoor unit is a two-pipe structure, and two connection pipes are provided between an indoor unit and the outdoor unit. That is, the first port and the second port are connected with the indoor unit. Compared with the three-pipe multi-split system in the related art, the two-pipe heat-recovery multi-split system provided by the present disclosure has a simple structure, and the cupper materials are saved, and the mounting cost is reduced.

In addition, the two-pipe enhanced-vapor-injection outdoor unit provided by the present disclosure is used in the two-pipe enhanced-vapor-injection multi-split system, and the multi-split system is a heat-recovery multi-split system. The heat recovery means that the heat discharged from the cooling room is recovered for heating of the heating room. In one embodiment, the system uses the indoor-unit heat exchanger to absorb heat from the cooling room, then the indoor-unit heat exchanger releases such heat completely or partially to the heating room for heating, and the heat lacked by the system or the remaining heat of the system is obtained from the environment by the outdoor-unit heat exchanger. However, for the ordinary heat-pump multi-split system, the heat may be required by the heating indoor unit totally comes from the heat absorption and the power consumption of the outdoor-unit heat exchanger. Thus, compared with the ordinary heat pump, the heat-recovery multi-split system has a significant energy-saving effect.

The heat-recovery multi-split system includes four operation modes, namely a cooling mode, a main cooling mode, a main heating mode and a heating mode. When all the operating indoor units are in the cooling mode/the heating mode, the outdoor unit operates in the cooling mode/the heating mode. When a part of the operating indoor units are in the cooling mode, another part of the operating indoor units are in the heating mode, and the cooling load is greater than the heating load, the outdoor unit will operate in the main cooling mode. When a part of the operating indoor units are in the cooling mode, another part of the operating indoor units are in the heating mode, and the cooling load is less than the heating load, the outdoor unit will operate in the main heating mode. If the flow rate may be required for running the cooling indoor units is exactly equal to the flow rate may be required for running the heating indoor units, the system operates in a full heat-recovery mode.

In addition, the two-pipe enhanced-vapor-injection outdoor unit according to embodiments of the present disclosure further includes following additional embodiments.

In one embodiment, the third end of the reversing assembly is switchably connected to the inlet of the outdoor heat exchanger or the outlet of the outdoor heat exchanger, and the fourth end of the reversing assembly is switchably connected to the second port or the first port.

In one embodiment, the third end of the reversing assembly is switchably connected to the inlet of the outdoor heat exchanger or the outlet of the outdoor heat exchanger, and the fourth end of the reversing assembly is switchably connected to the second port or the first port. When the two-pipe enhanced-vapor-injection multi-split system is in the cooling mode and the main cooling mode, the third end of the reversing assembly is connected to the inlet of the outdoor heat exchanger, and the fourth end of the reversing assembly is connected to the second port. When the two-pipe enhanced-vapor-injection multi-split system is in the heating mode and the main heating mode, the third end of the reversing assembly is connected to the outlet of the outdoor heat exchanger, and the fourth end of the reversing assembly is connected to the first port, to achieve different flow directions of the refrigerant.

In one embodiment, an inlet of the main heat-exchange flow path is connected with the first port and the second port, an inlet of the auxiliary heat-exchange flow path is connected with the outlet of the main heat-exchange flow path, and an outlet of the auxiliary heat-exchange flow path is connected with the injection port.

In one embodiment, a specific connection manner inside the super cooler is provided, that is, the inlet of the main heat-exchange flow path is connected to the first port and the second port, the inlet of the auxiliary heat-exchange flow path is connected to the outlet of the main heat-exchange flow path, and the outlet of the auxiliary heat-exchange flow path is connected to the injection port. In the heating mode or the main heating mode, the refrigerant flowing in through the second port first enters the inlet of the main heat-exchange flow path, then enters the inlet of the auxiliary heat-exchange flow path from the outlet of the main heat-exchange flow path, and further enters the injection port from the outlet of the auxiliary heat-exchange flow path, to achieve the enhanced-vapor-injection compression of the enhanced-vapor-injection compressor.

In one embodiment, the inlet of the main heat-exchange flow path and the inlet of the auxiliary heat-exchange flow path are both connected to the first port and the second port, and the outlet of the auxiliary heat-exchange flow path is connected to the injection port.

In one embodiment, a specific connection manner inside the super cooler is provided, that is, the inlet of the main heat-exchange flow path and the inlet of the auxiliary heat-exchange flow path are both connected to the first port and the second port, and the outlet of the auxiliary heat-exchange flow path is connected to the injection port. In the heating mode or the main heating mode, the refrigerant flowing in through the second port enters the inlet of the main heat-exchange flow path and the inlet of the auxiliary heat-exchange flow path, respectively, and then passes through the main heat-exchange flow path and the auxiliary heat-exchange flow path, respectively; the refrigerant flowing out of the main heat-exchange flow path passes through the throttling assembly and enters the inlet of the outdoor heat exchanger; the refrigerant flowing out of the auxiliary heat-exchange flow path enters the enhanced-vapor-injection compressor through the injection port, to achieve the enhanced-vapor-injection compression of the enhanced-vapor-injection compressor.

In one embodiment, the two-pipe enhanced-vapor-injection outdoor unit includes a first solenoid valve disposed between the auxiliary heat-exchange flow path and the injection port, and the first solenoid valve has a conduction direction from the auxiliary heat-exchange flow path to the injection port.

In one embodiment, the two-pipe enhanced-vapor-injection outdoor unit includes the first solenoid valve, and the first solenoid valve is conducted when powered on, and closed when powered off. When the first solenoid valve is powered on to be conducted, the conduction direction of the first solenoid valve is from the auxiliary heat-exchange flow path to the injection port, i.e. a conduction direction, in which the refrigerant is only allowed to flow from the auxiliary heat-exchange flow path to the injection port, to avoid the refrigerant backflow phenomenon.

In one embodiment, the two-pipe enhanced-vapor-injection outdoor unit includes a first check valve disposed in the first pipe, and the first check valve has a conduction direction from the outlet of the outdoor heat exchanger to the throttling assembly.

In one embodiment, by adding the first pipe, the outlet of the outdoor heat exchanger and the main heat-exchange flow path are connected. The first check valve is arranged in the first pipe, and a solenoid valve is added between a high pressure valve and a check valve at the outlet of the outdoor heat exchanger, to prevent the gas from being exchanged between the outlet of the outdoor heat exchanger and the main heat-exchange flow path, and thus only the refrigerant from the outlet of the super cooler 20 is allowed to flow to the high pressure valve.

In one embodiment, the two-pipe enhanced-vapor-injection outdoor unit includes a second check valve and a third check valve. The second check valve connects the first port with the main heat-exchange flow path, and has a conduction direction from the main heat-exchange flow path to the first port. The third check valve connects the second port with the main heat-exchange flow path, and has a conduction direction from the second port to the main heat-exchange flow path.

In one embodiment, the two-pipe enhanced-vapor-injection outdoor unit includes the second check valve and the third check valve. The second check valve connects the first port to the main heat-exchange flow path. The second check valve has the conduction direction from the main heat-exchange flow path to the first port. The third check valve connects the second port to the main heat-exchange flow path. The third check valve has the conduction direction from the second port to the main heat-exchange flow path. During operations in the cooling mode and the main cooling mode, the second check valve is conducted, and the third check valve is closed. During operations in the heating mode and the main heating mode, the third check valve is conducted, and the second check valve is closed.

In one embodiment, the two-pipe enhanced-vapor-injection outdoor unit includes a fourth check valve and a fifth check valve. The fourth check valve connects the third end of the reversing assembly to the inlet of the outdoor heat exchanger, and has a conduction direction from the third end of the reversing assembly to the outdoor heat exchanger. The fifth check valve connects the third end of the reversing assembly to the outlet of the outdoor heat exchanger, and has a conduction direction from the outlet of the outdoor heat exchanger to the third end of the reversing assembly.

In one embodiment, the two-pipe enhanced-vapor-injection outdoor unit includes the fourth check valve and the fifth check valve. The fourth check valve and the fifth check valve are both connected with the third end of the reversing assembly, and the other ends of the fourth check valve and the fifth check valve are connected to the inlet of the outdoor heat exchanger and the outlet of the outdoor heat exchanger, respectively. During operations in the cooling mode and the main cooling mode, the fourth check valve is conducted, and the fifth check valve is closed. During operations in the heating mode and the main heating mode, the fifth check valve is conducted, and the fourth check valve is closed.

In one embodiment, the two-pipe enhanced-vapor-injection outdoor unit includes a sixth check valve and a seventh check valve. The sixth check valve connects the fourth end of the reversing assembly to the second port, and has a conduction direction from the second port to the fourth end of the reversing assembly. The seventh check valve connects the fourth end of the reversing assembly to the second port, and has a conduction direction from the fourth end of the reversing assembly to the second port.

In one embodiment, the two-pipe enhanced-vapor-injection outdoor unit includes the sixth check valve and the seventh check valve. The conduction direction of the sixth check valve is from the second port to the fourth end of the reversing assembly, and the conduction direction of the seventh check valve is from the fourth end of the reversing assembly to the second port. During operations in the cooling mode and the main cooling mode, the sixth check valve is conducted, and the seventh check valve is closed. During operations in the heating mode and the main heating mode, the seventh check valve is conducted, and the sixth check valve is closed.

In one embodiment, the two-pipe enhanced-vapor-injection outdoor unit includes a second pipe connecting the gas discharge port to the first port, and a second solenoid valve disposed in the second pipe, and having a conduction direction from the gas discharge port to the first port.

In one embodiment, the two-pipe enhanced-vapor-injection outdoor unit includes the second pipe and the second solenoid valve disposed in the second pipe. During the operation in the cooling mode, the second solenoid valve is closed, and all the refrigerant discharged out of the gas discharge port enters the inlet of the outdoor heat exchanger through the third end of the reversing assembly. During the operation in the main cooling mode, the second solenoid valve is turned on, a part of the refrigerant discharged out of the gas discharge port enters the inlet of the outdoor heat exchanger through the third end of the reversing assembly, and another part of the refrigerant discharged out of the gas discharge port enters the first port through the second solenoid valve, to ensure that the two-pipe enhanced-vapor-injection multi-split system can realize the cooling mode and the main cooling mode.

In one embodiment, the throttling assembly includes at least one throttling device and at least one eighth check valve connected in series, and the eighth check valve has a conduction direction from the super cooler to the inlet of the outdoor heat exchanger.

In one embodiment, the throttling assembly includes the at least one throttling device and the at least one eighth check valve connected in series. The conduction direction of the eighth check valve is from the super cooler 20 to the inlet of the outdoor heat exchanger. One throttling device may be connected in series with one eighth check valve, or one throttling device may be connected in series with eighth check valves, or throttling devices may be connected in series with one eighth check valve, to ensure the effects of throttling and depressurization, and thus a better depressurization effect can be achieved after multi-stage depressurizations.

According to one embodiment of the present disclosure, a two-pipe enhanced-vapor-injection multi-split system is provided. The two-pipe enhanced-vapor-injection multi-split system includes the two-pipe enhanced-vapor-injection outdoor unit according to any of the above embodiments. Therefore, the two-pipe enhanced-vapor-injection multi-split system has all the significant effects of the two-pipe enhanced-vapor-injection outdoor unit according to any of the above embodiments.

BRIEF DESCRIPTION OF THE DRAWINGS

Embodiments of the present disclosure will become apparent and more readily appreciated from the following descriptions made with reference to the drawings, in which.

REFERENCE NUMERALS

Figure 1:
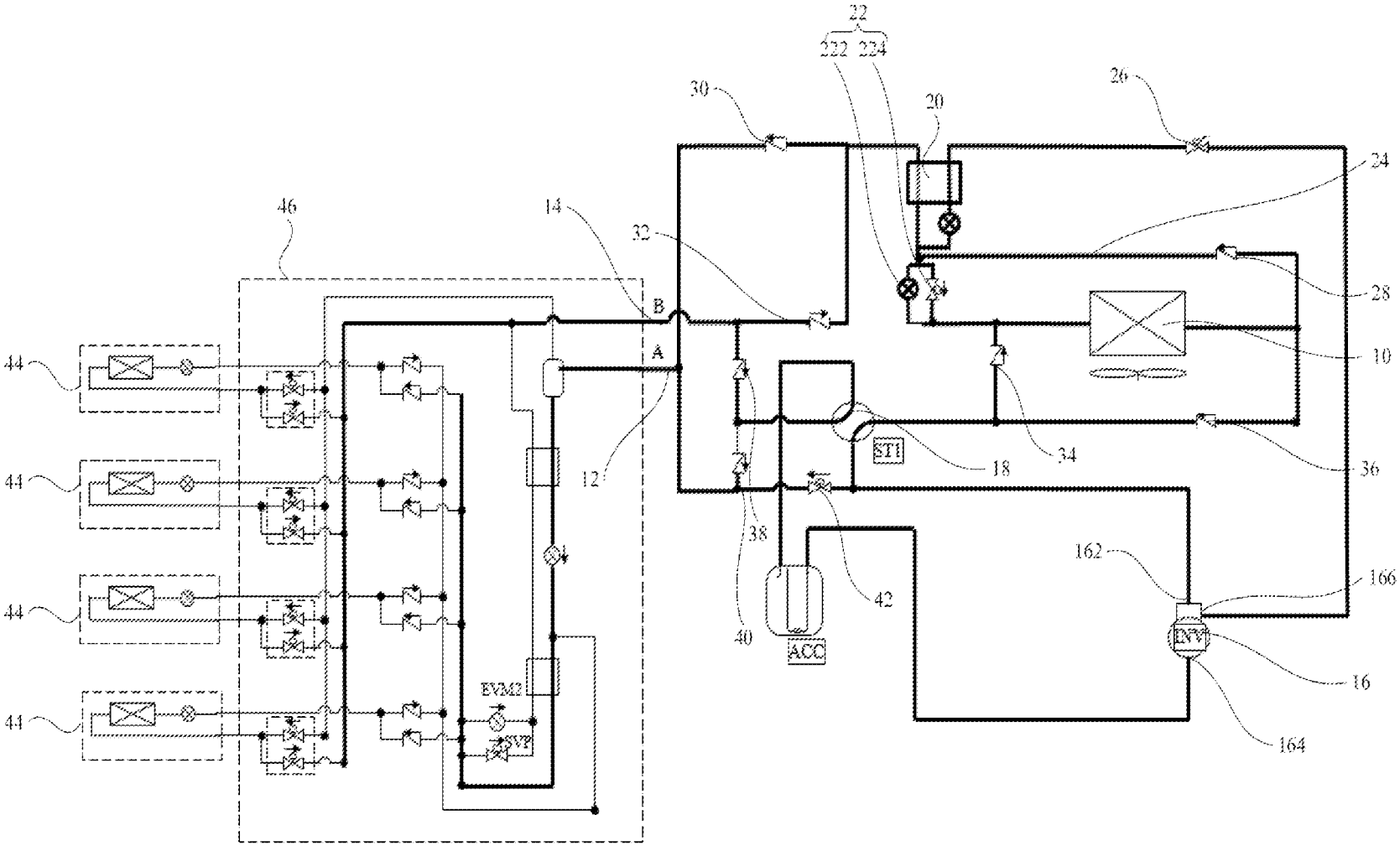
FIG. 1 illustrates a schematic view of a two-pipe enhanced-vapor-injection multi-split system provided by an embodiment of the present disclosure.
Figure 2:
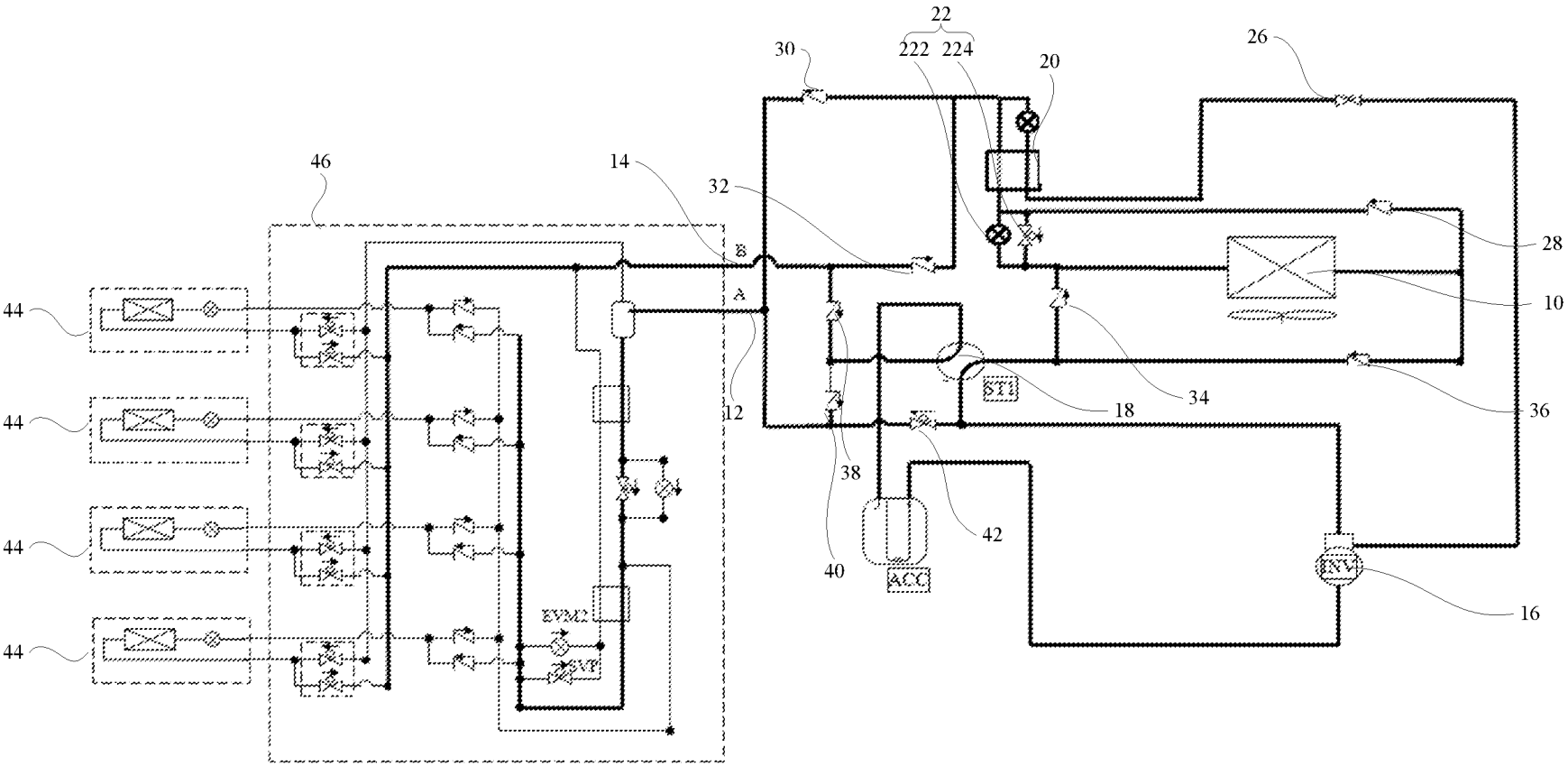
FIG. 2 illustrates another schematic view of a two-pipe enhanced-vapor-injection multi-split system provided by an embodiment of the present disclosure.

Reference numerals in FIG. 1 to FIG. 6 have following corresponding relationships with names of parts.

10 outdoor heat exchanger, 12 first port, 14 second port, 16 enhanced-vapor-injection compressor, 162 gas discharge port, 164 gas return port, 166 injection port, 18 reversing assembly, 20 super cooler, 22 throttling assembly, 222 throttling device, 224 eighth check valve, 24 first pipe, 26 first solenoid valve, 28 first check valve, 30 second check valve, 32 third check valve, 34 fourth check valve, 36 fifth check valve, 38 sixth check valve, 40 seventh check valve, 42 second solenoid valve, 44 two-pipe enhanced-vapor-injection indoor unit, 46 refrigerant-flow-direction switching device.

DETAILED DESCRIPTION OF THE DISCLOSURE

In the following descriptions, many specific details are set forth to provide a thorough understanding of the present disclosure. However, the present disclosure may be implemented in other manners other than what are described herein. The scope protection of the present disclosure is not limited by the specific embodiments disclosed below.

A two-pipe enhanced-vapor-injection outdoor unit and system according to an embodiment of the present disclosure will be described with reference to FIGS. 1 to 7.

As illustrated in FIGS. 1 to 6, the two-pipe enhanced-vapor-injection outdoor unit provided by the present disclosure includes: an outdoor heat exchanger 10, a first port 12 and a second port 14; an enhanced-vapor-injection compressor 16 having an gas discharge port 162, an gas return port 164 and an injection port 166; a reversing assembly 18, including first to fourth ends, the first end of the reversing assembly 18 being connected with the gas discharge port 162, and the second end of the reversing assembly 18 being connected with the gas return port 164; a super cooler 20, including a main heat-exchange flow path and an auxiliary heat-exchange flow path communicated with each other, the main heat-exchange flow path being connected with the first port 12 and the second port 14, the auxiliary heat-exchange flow path being connected with the injection port 166; a throttling assembly 22 having a first end connected with an outlet of the main heat-exchange flow path, and a second end connected with an inlet of the outdoor heat exchanger 10; a first pipe 24 having a first end connected with the outlet of the outdoor heat exchanger 10, and a second end arranged between the throttling assembly 22 and the main heat-exchange flow path.

The two-pipe enhanced-vapor-injection outdoor unit provided by the present disclosure includes the outdoor heat exchanger 10, the enhanced-vapor-injection compressor 16, the reversing assembly 18, the super cooler 20, the throttling assembly 22 and the first pipe 24. The first end of the reversing assembly 18 is connected with the gas discharge port 162, and the second end of the reversing assembly 18 is connected with the gas return port 164. The main heat-exchange flow path of the super cooler 20 is communicated with the auxiliary heat-exchange flow path of the super cooler 20. The main heat-exchange flow path is connected with the first port 12 and the second port 14, respectively. The auxiliary heat-exchange flow path is connected with the injection port 166. The first end of the throttling assembly 22 is connected with the outlet of the main heat-exchange flow path, and the second end of the throttling assembly 22 is connected with the inlet of the outdoor heat exchanger 10. The first end of the first pipe 24 is connected with the outlet of the outdoor heat exchanger 10, and the second end of the first pipe 24 is arranged between the throttling assembly 22 and the main heat-exchange flow path. In the present disclosure, by using the enhanced-vapor-injection compressor 16, the gaseous refrigerant flowing out of the enhanced-vapor-injection heat exchanger directly enters the compressor through the middle injection port 166 for the enhanced-vapor-injection compression. Moreover, the super cooler 20 and the throttling assembly 22 are added to significantly increase a refrigerant circulation in a heating operation at a low temperature, and a range of the heating operation at the low temperature is expanded in the two-pipe enhanced-vapor-injection outdoor unit, and also the heating capacity is improved significantly. In addition, the first pipe 24 is added, and the super cooler 20 can improve a super cooling degree at the outlet of the outdoor heat exchanger 10, to reduce an exhaust superheat degree, and improve the heating capacity at a high temperature.

The two-pipe enhanced-vapor-injection outdoor unit is a two-pipe structure, and two connection pipes are provided between an indoor unit and the outdoor unit. That is, the first port 12 and the second port 14 are connected with the indoor unit. Compared with the three-pipe multi-split system in the related art, the two-pipe heat-recovery multi-split system provided by the present disclosure has a simple structure, and the cupper materials are saved, and the mounting cost is reduced.

In addition, the two-pipe enhanced-vapor-injection outdoor unit provided by the present disclosure is used in the two-pipe enhanced-vapor-injection multi-split system, and the multi-split system is a heat-recovery multi-split system. The heat recovery means that the heat discharged from the cooling room is recovered for heating of the heating room. In one embodiment, the system uses the indoor-unit heat exchanger to absorb heat from the cooling room, then the indoor-unit heat exchanger releases such heat completely or partially to the heating room for heating, and the heat lacked by the system or the remaining heat of the system is obtained from the environment by the outdoor-unit heat exchanger. However, for the ordinary heat-pump multi-split system, the heat may be required by the heating indoor unit totally comes from the heat absorption and the power consumption of the outdoor-unit heat exchanger. Thus, compared with the ordinary heat pump, the heat-recovery multi-split system has a significant energy-saving effect.

The heat-recovery multi-split system includes four operation modes, namely a cooling mode, a main cooling mode, a main heating mode and a heating mode. When all the operating indoor units are in the cooling mode/the heating mode, the outdoor unit operates in the cooling mode/the heating mode. When a part of the operating indoor units are in the cooling mode, another part of the operating indoor units are in the heating mode, and the cooling load is greater than the heating load, the outdoor unit will operate in the main cooling mode. When a part of the operating indoor units are in the cooling mode, another part of the operating indoor units are in the heating mode, and the cooling load is less than the heating load, the outdoor unit will operate in the main heating mode. If the flow rate may be required for running the cooling indoor units is exactly equal to the flow rate may be required for running the heating indoor units, the system operates in a full heat-recovery mode.

A throttling element is connected in series at an inlet of the auxiliary heat-exchange flow path of the super cooler 20.

In an embodiment provided by the present disclosure, the third end of the reversing assembly 18 is switchably connected to the inlet of the outdoor heat exchanger 10 or the outlet of the outdoor heat exchanger 10, and the fourth end of the reversing assembly 18 is switchably connected to the second port 14 or the first port 12.

In this embodiment, the third end of the reversing assembly 18 is switchably connected to the inlet of the outdoor heat exchanger 10 or the outlet of the outdoor heat exchanger 10, and the fourth end of the reversing assembly 18 is switchably connected to the second port 14 or the first port 12. When the two-pipe enhanced-vapor-injection multi-split system is in the cooling mode and the main cooling mode, the third end of the reversing assembly 18 is connected to the inlet of the outdoor heat exchanger 10, and the fourth end of the reversing assembly 18 is connected to the second port 14. When the two-pipe enhanced-vapor-injection multi-split system is in the heating mode and the main heating mode, the third end of the reversing assembly 18 is connected to the outlet of the outdoor heat exchanger 10, and the fourth end of the reversing assembly 18 is connected to the first port 12, to achieve different flow directions of the refrigerant.

In an embodiment provided by the present disclosure, the inlet of the main heat-exchange flow path is connected to the first port 12 and the second port 14, the inlet of the auxiliary heat-exchange flow path is connected to the outlet of the main heat-exchange flow path, and the outlet of the auxiliary heat-exchange flow path is connected to the injection port 166.

In this embodiment, a specific connection manner inside the super cooler 20 is provided, that is, the inlet of the main heat-exchange flow path is connected to the first port 12 and the second port 14, the inlet of the auxiliary heat-exchange flow path is connected to the outlet of the main heat-exchange flow path, and the outlet of the auxiliary heat-exchange flow path is connected to the injection port 166. In the heating mode or the main heating mode, the refrigerant flowing in through the second port 14 first enters the inlet of the main heat-exchange flow path, then enters the inlet of the auxiliary heat-exchange flow path from the outlet of the main heat-exchange flow path, and further enters the injection port 166 from the outlet of the auxiliary heat-exchange flow path, to achieve the enhanced-vapor-injection compression of the enhanced-vapor-injection compressor 16.

In an embodiment provided by the present disclosure, the inlet of the main heat-exchange flow path and the inlet of the auxiliary heat-exchange flow path are both connected to the first port 12 and the second port 14, and the outlet of the auxiliary heat-exchange flow path is connected to the injection port 166.

In this embodiment, a specific connection manner inside the super cooler 20 is provided, that is, the inlet of the main heat-exchange flow path and the inlet of the auxiliary heat-exchange flow path are both connected to the first port 12 and the second port 14, and the outlet of the auxiliary heat-exchange flow path is connected to the injection port 166. In the heating mode or the main heating mode, the refrigerant flowing in through the second port 14 enters the inlet of the main heat-exchange flow path and the inlet of the auxiliary heat-exchange flow path, respectively, and then passes through the main heat-exchange flow path and the auxiliary heat-exchange flow path, respectively; the refrigerant flowing out of the main heat-exchange flow path passes through the throttling assembly 22 and enters the inlet of the outdoor heat exchanger 10; the refrigerant flowing out of the auxiliary heat-exchange flow path enters the enhanced-vapor-injection compressor 16 through the injection port 166, to achieve the enhanced-vapor-injection compression of the enhanced-vapor-injection compressor 16.

In an embodiment provided by the present disclosure, the two-pipe enhanced-vapor-injection outdoor unit includes a first solenoid valve 26 disposed between the auxiliary heat-exchange flow path and the injection port 166, and the first solenoid valve 26 has a conduction direction from the auxiliary heat-exchange flow path to the injection port 166.

In this embodiment, the two-pipe enhanced-vapor-injection outdoor unit includes the first solenoid valve 26, and the first solenoid valve 26 is conducted when powered on, and closed when powered off. When the first solenoid valve 26 is powered on to be conducted, the conduction direction of the first solenoid valve 26 is from the auxiliary heat-exchange flow path to the injection port 166, i.e. a conduction direction, in which the refrigerant is only allowed to flow from the auxiliary heat-exchange flow path to the injection port 166, to avoid the refrigerant backflow phenomenon.

In an embodiment provided by the present disclosure, the two-pipe enhanced-vapor-injection outdoor unit includes a first check valve 28 disposed in the first pipe 24, and the first check valve 28 has a conduction direction from the outlet of the outdoor heat exchanger 10 to the throttling assembly 22.

In this embodiment, by adding the first pipe 24, the outlet of the outdoor heat exchanger 10 and the main heat-exchange flow path are connected. The first check valve 28 is arranged in the first pipe 24, and a solenoid valve is added between a high pressure valve and a check valve at the outlet of the outdoor heat exchanger 10, to prevent the gas from being exchanged between the outlet of the outdoor heat exchanger 10 and the main heat-exchange flow path, and thus only the refrigerant from the outlet of the super cooler 20 is allowed to flow to the high pressure valve.

In an embodiment provided by the present disclosure, the two-pipe enhanced-vapor-injection outdoor unit includes a second check valve 30 and a third check valve 32. The second check valve 30 connects the first port 12 with the main heat-exchange flow path, and has a conduction direction from the main heat-exchange flow path to the first port 12. The third check valve 32 connects the second port 14 with the main heat-exchange flow path, and has a conduction direction from the second port 14 to the main heat-exchange flow path.

In this embodiment, the two-pipe enhanced-vapor-injection outdoor unit includes the second check valve 30 and the third check valve 32. The second check valve 30 connects the first port 12 to the main heat-exchange flow path. The second check valve 30 has the conduction direction from the main heat-exchange flow path to the first port 12. The third check valve 32 connects the second port 14 to the main heat-exchange flow path. The third check valve 32 has the conduction direction from the second port 14 to the main heat-exchange flow path. During operations in the cooling mode and the main cooling mode, the second check valve 30 is conducted, and the third check valve 32 is closed. During operations in the heating mode and the main heating mode, the third check valve 32 is conducted, and the second check valve 30 is closed.

In an embodiment provided by the present disclosure, the two-pipe enhanced-vapor-injection outdoor unit includes a fourth check valve 34 and a fifth check valve 36. The fourth check valve 34 connects the third end of the reversing assembly 18 to the inlet of the outdoor heat exchanger 10, and has a conduction direction from the third end of the reversing assembly 18 to the outdoor heat exchanger 10. The fifth check valve 36 connects the third end of the reversing assembly 18 to the outlet of the outdoor heat exchanger 10, and has a conduction direction from the outlet of the outdoor heat exchanger 10 to the third end of the reversing assembly 18.

In this embodiment, the two-pipe enhanced-vapor-injection outdoor unit includes the fourth check valve 34 and the fifth check valve 36. The fourth check valve 34 and the fifth check valve 36 are both connected with the third end of the reversing assembly 18, and the other ends of the fourth check valve 34 and the fifth check valve 36 are connected to the inlet of the outdoor heat exchanger 10 and the outlet of the outdoor heat exchanger 10, respectively. During operations in the cooling mode and the main cooling mode, the fourth check valve 34 is conducted, and the fifth check valve 36 is closed. During operations in the heating mode and the main heating mode, the fifth check valve 36 is conducted, and the fourth check valve 34 is closed.

In an embodiment provided by the present disclosure, the two-pipe enhanced-vapor-injection outdoor unit includes a sixth check valve 38 and a seventh check valve 40. The sixth check valve 38 connects the fourth end of the reversing assembly 18 to the second port 14, and has a conduction direction from the second port 14 to the fourth end of the reversing assembly 18. The seventh check valve 40 connects the fourth end of the reversing assembly 18 to the second port 14, and has a conduction direction from the fourth end of the reversing assembly 18 to the second port 14.

In this embodiment, the two-pipe enhanced-vapor-injection outdoor unit includes the sixth check valve 38 and the seventh check valve 40. The conduction direction of the sixth check valve 38 is from the second port 14 to the fourth end of the reversing assembly 18, and the conduction direction of the seventh check valve 40 is from the fourth end of the reversing assembly 18 to the second port 14. During operations in the cooling mode and the main cooling mode, the sixth check valve 38 is conducted, and the seventh check valve 40 is closed. During operations in the heating mode and the main heating mode, the seventh check valve 40 is conducted, and the sixth check valve 38 is closed.

In an embodiment provided by the present disclosure, the two-pipe enhanced-vapor-injection outdoor unit includes a second pipe connecting the gas discharge port 162 to the first port 12, and a second solenoid valve 42 disposed in the second pipe, and having a conduction direction from the gas discharge port 162 to the first port 12.

In this embodiment, the two-pipe enhanced-vapor-injection outdoor unit includes the second pipe and the second solenoid valve 42 disposed in the second pipe. During the operation in the cooling mode, the second solenoid valve 42 is closed, and all the refrigerant discharged out of the gas discharge port 162 enters the inlet of the outdoor heat exchanger 10 through the third end of the reversing assembly 18. During the operation in the main cooling mode, the second solenoid valve 42 is turned on, a part of the refrigerant discharged out of the gas discharge port 162 enters the inlet of the outdoor heat exchanger 10 through the third end of the reversing assembly 18, and another part of the refrigerant discharged out of the gas discharge port 162 enters the first port 12 through the second solenoid valve 42, to ensure that the two-pipe enhanced-vapor-injection multi-split system can realize the cooling mode and the main cooling mode.

In an embodiment provided by the present disclosure, the throttling assembly 22 includes at least one throttling device 222 and at least one eighth check valve 224 connected in series, and the eighth check valve 224 has a conduction direction from the super cooler 20 to the inlet of the outdoor heat exchanger 10.

In this embodiment, the throttling assembly 22 includes the at least one throttling device 222 and the at least one eighth check valve 224 connected in series. The conduction direction of the eighth check valve 224 is from the super cooler 20 to the inlet of the outdoor heat exchanger 10. One throttling device 222 may be connected in series with one eighth check valve 224, or one throttling device 222 may be connected in series with eighth check valves 224, or throttling devices 222 may be connected in series with one eighth check valve 224, to ensure the effects of throttling and depressurization, and thus a better depressurization effect can be achieved after multi-stage depressurizations.

According to one embodiment of the present disclosure, a two-pipe enhanced-vapor-injection multi-split system is provided. The two-pipe enhanced-vapor-injection multi-split system includes the two-pipe enhanced-vapor-injection outdoor unit according to any of the above embodiments. Therefore, the two-pipe enhanced-vapor-injection multi-split system has all the significant effects of the two-pipe enhanced-vapor-injection outdoor unit according to any of the above embodiments.

The two-pipe enhanced-vapor-injection multi-split system includes a refrigerant-flow-direction switching device 46, and the refrigerant-flow-direction switching device 46 includes a gas-liquid separator for shunting of the gas-liquid two-phase refrigerant. A plate heat exchanger is used for obtaining a super cooling degree of a liquid refrigerant. Multiple groups of solenoid valves are used to switch the flow direction of the refrigerant.

Figure 3:
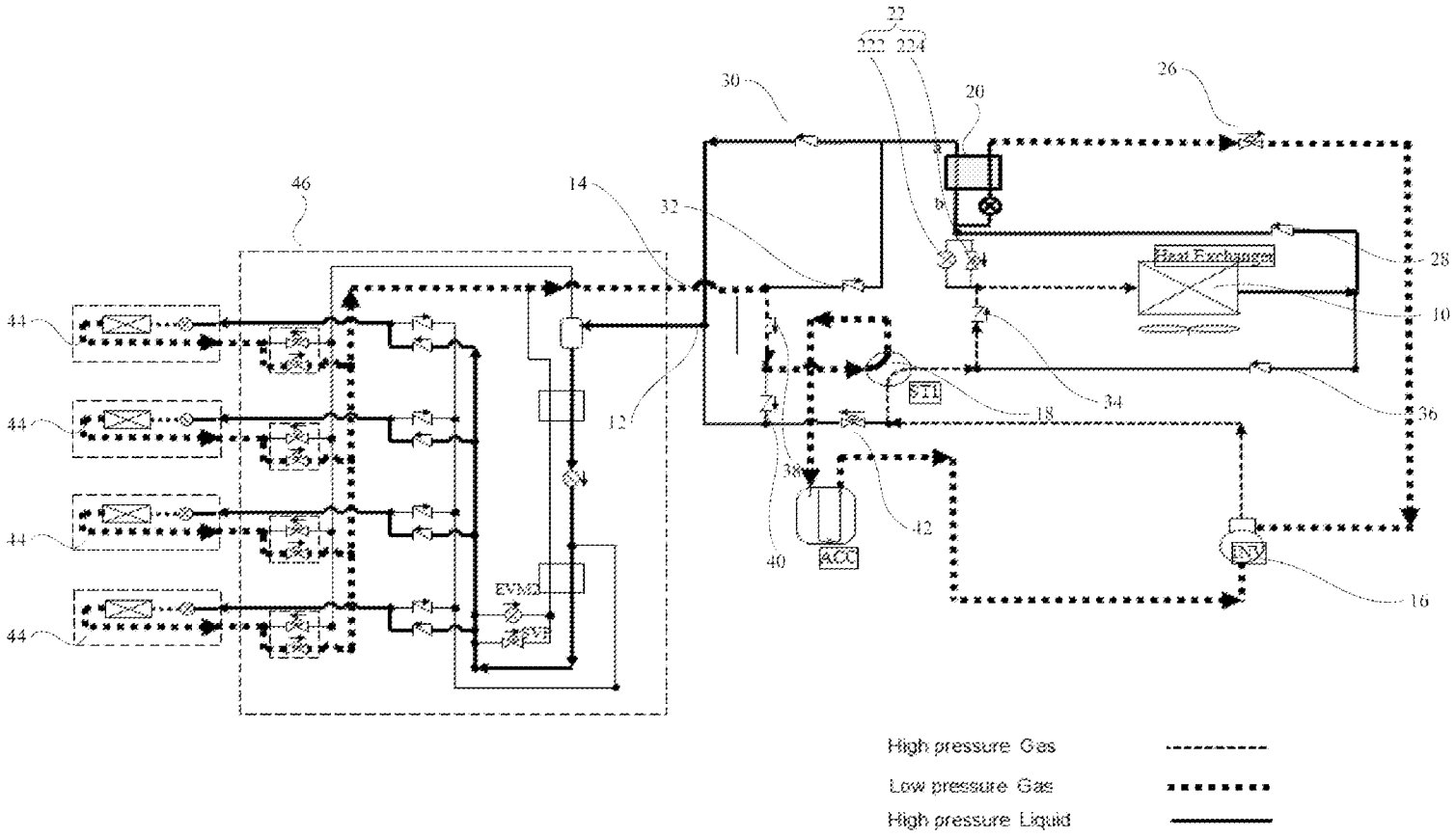
FIG. 3 illustrates a schematic view of a two-pipe enhanced-vapor-injection multi-split system in a cooling mode provided by an embodiment of the present disclosure.

As shown in FIG. 3, during cooling, the high-temperature and high-pressure gaseous refrigerant comes out of the enhanced-vapor-injection compressor 16, first passes through the reversing assembly 18 and the fourth check valve 34, and enters the outdoor heat exchanger 10 to be condensed. The condensed high-pressure liquid refrigerant enters the inlet of the main path of the super cooler 20 after passing through the first check valve 28, and another part of the refrigerant enters the super cooler 20 through the inlet of the auxiliary path of the super cooler 20 after being throttled by the throttling assembly 22, further flows out of the auxiliary outlet of the super cooler 20, and then passes through the first solenoid valve 26 into the injection port 166. The high-pressure liquid refrigerant, which enters the super cooler 20 through the inlet of the main path of the super cooler 20 to be condensed into a super cooled refrigerant, flows out of the outlet of the main path of the super cooler 20, passes through the second check valve 30 and the high pressure valve, enters the inlet of the refrigerant-flow-direction switching device 46, flows out of the outlet of the refrigerant-flow-direction switching device 46 at a side where the gas-liquid separator is, passes through a first super cooling device and a second super cooling device of the refrigerant-flow-direction switching device 46 to be super cooled, further flows through a refrigeration check valve and an indoor-unit electronic expansion valve, and enters the two-pipe enhanced-vapor-injection indoor unit 44 through a liquid pipe. The low-pressure gaseous refrigerant formed after evaporation and heat exchange in the two-pipe enhanced-vapor-injection indoor unit 44 returns to the two-pipe enhanced-vapor-injection outdoor unit through a low-pressure valve in a return pipe, further back to a low pressure tank through the check valve, i.e. the sixth check valve 38, and the reversing assembly 18, and then back to the gas return port 164.

Figure 4:
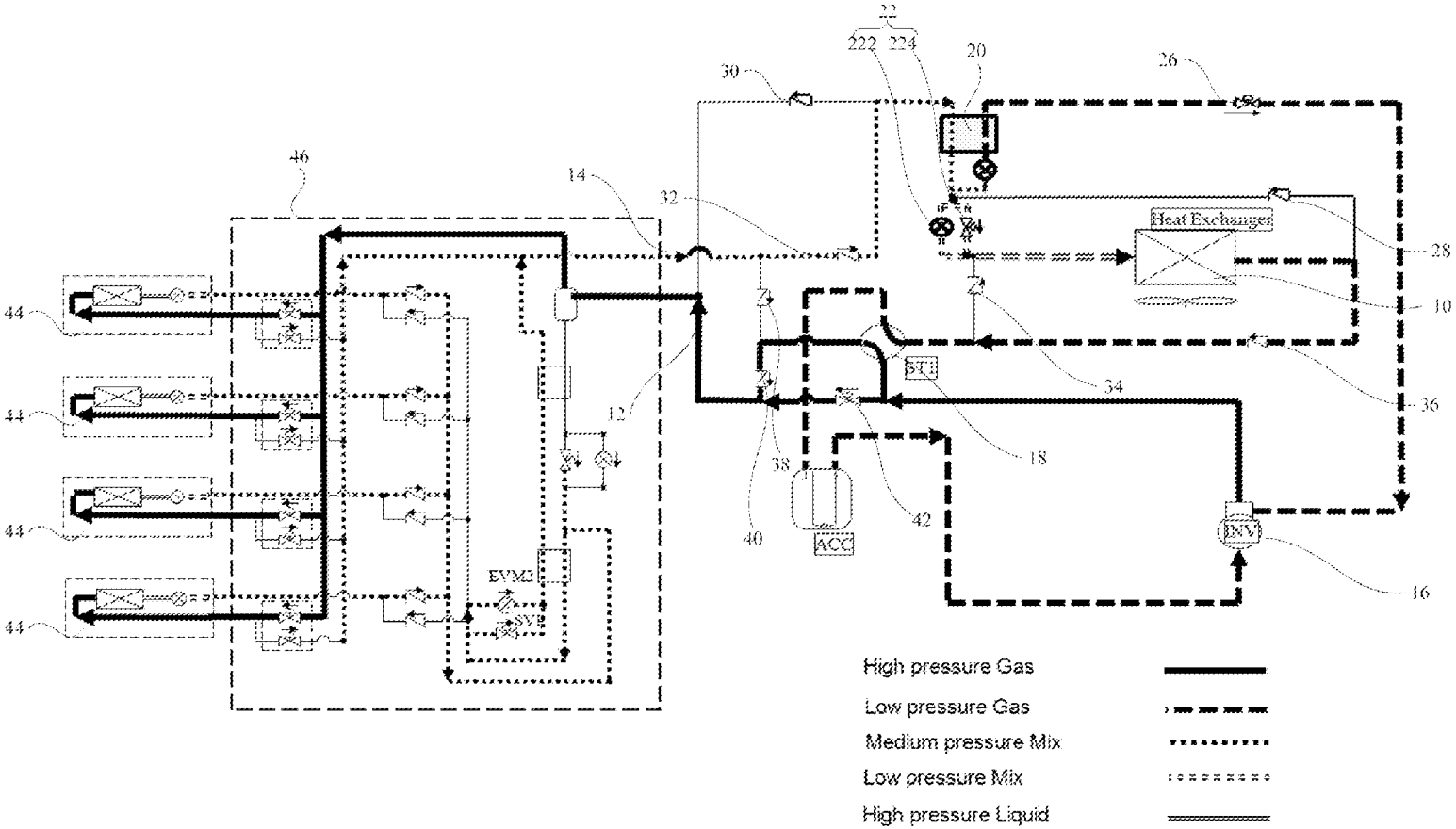
FIG. 4 illustrates a schematic view of a two-pipe enhanced-vapor-injection multi-split system in a heating mode provided by an embodiment of the present disclosure.

As shown in FIG. 4, during heating, the high-temperature and high-pressure gaseous refrigerant comes out of the enhanced-vapor-injection compressor 16, passes through two paths, i.e. the second solenoid valve 42 as well as the reversing assembly 18 and the seventh check valve 40, to the high pressure valve, respectively, then flows from the high pressure valve to the inlet of the refrigerant-flow-direction switching device 46 through a high pressure pipe, further enters the gas-liquid separator, and then enters the two-pipe enhanced-vapor-injection indoor unit 44 through the gas pipe from a gas outlet of the gas-liquid separator after passing through the heating solenoid valve. After being condensed into a high-pressure liquid refrigerant in the two-pipe enhanced-vapor-injection indoor unit 44, the refrigerant flows through the electronic expansion valve of the two-pipe enhanced-vapor-injection indoor unit 44, and becomes a high-pressure two-phase refrigerant. The high-pressure two-phase refrigerant flows through the throttling element of the refrigerant-flow-direction switching device 46, returns to the low pressure pipe, passes through the low pressure valve into the two-pipe enhanced-vapor-injection outdoor unit, and further enters the inlet of the main path of the super cooler 20 after passing through the third check valve 32. After flowing out of the outlet of the main path of the super cooler 20, a part of the refrigerant passes through the throttling assembly 22, becomes a low-pressure two-phase refrigerant, further enters the outdoor heat exchanger 10 to absorb heat, then returns to the low pressure tank via the reversing assembly 18, and further enters the gas return port 164. Another part of the refrigerant passes through the throttling assembly 22, and enters the inlet of the auxiliary path of the super cooler 20. After flowing out of the outlet of the auxiliary path of the super cooler 20, a medium-pressure gaseous refrigerant enters a compression chamber of the compressor through the first solenoid valve 26.

Figure 7:
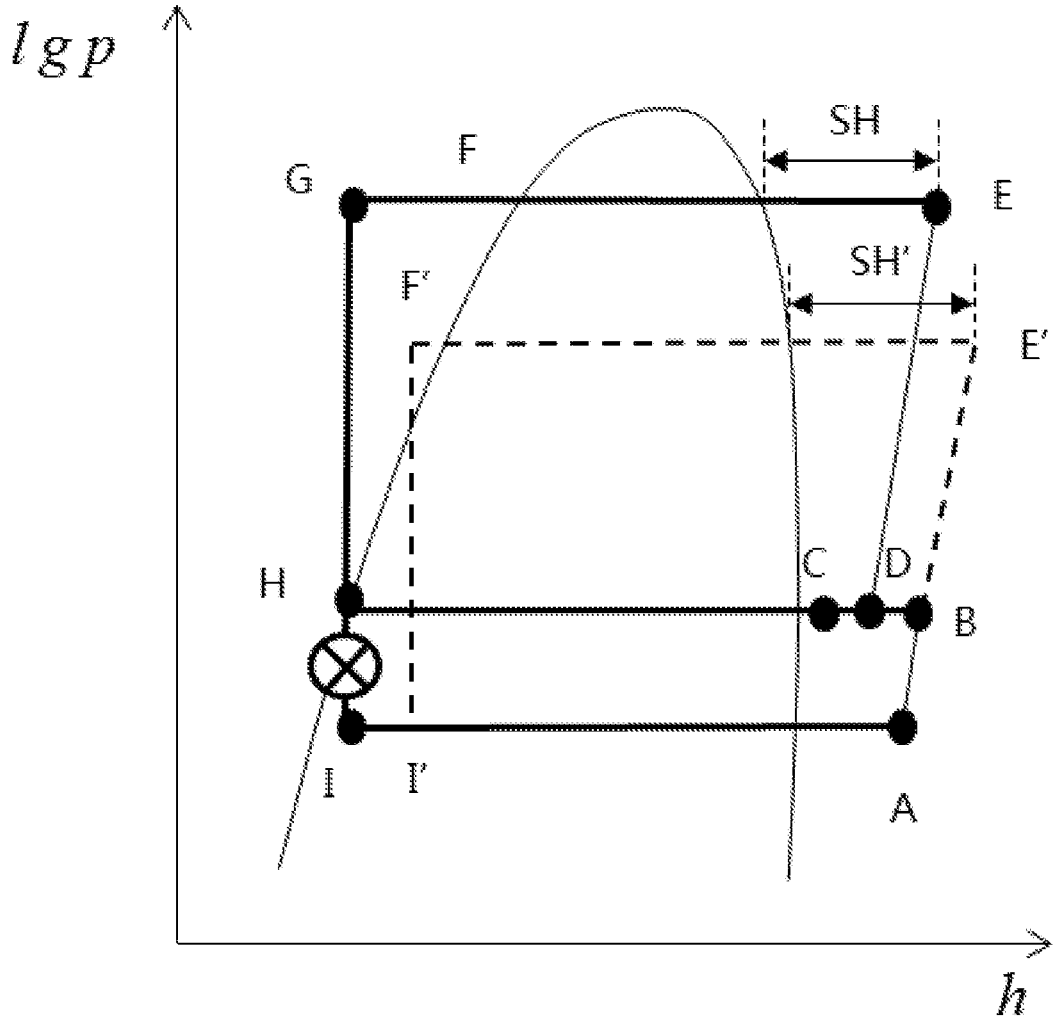
FIG. 7 illustrates a pressure-enthalpy diagram of a two-pipe enhanced-vapor-injection multi-split system provided by an embodiment of the present disclosure.

FIG. 7 shows a pressure-enthalpy diagram which indicates that the two-pipe enhanced-vapor-injection multi-split system provided by the present disclosure can significantly increase the capacity of the heating indoor unit, especially under a low temperature condition. A point C in FIG. 7 indicates a state of the injection port of the enhanced-vapor-injection compressor. The refrigerant in the main path first enters the enhanced-vapor-injection compressor through the low-pressure chamber and is compressed to a point B, then is mixed with the refrigerant injected into the enhanced-vapor-injection compressor at the point C to reach a point D, and further continues to be compressed. The refrigerant injected into the compressor through the injection port C is the medium-pressure refrigerant, and has a density much higher than a density of the refrigerant at a point A of the gas return port, so that the circulation of the refrigerant is greatly increased, and also the exhaust superheat degree is decreased to increase a pressure ratio. Thus, the heating capacity is greatly improved.

As shown in FIG. 7, the system can have a lower super cooling degree during cooling, and the same cooling capacity can be achieved with a lower refrigerant circulation, to improve the energy efficiency. Since the exhaust superheat degree SH<SH' during the enhanced vapor injection, the system frequency can run high during the high-temperature cooling, and hence the high-temperature cooling capacity can be improved.

Figure 5:
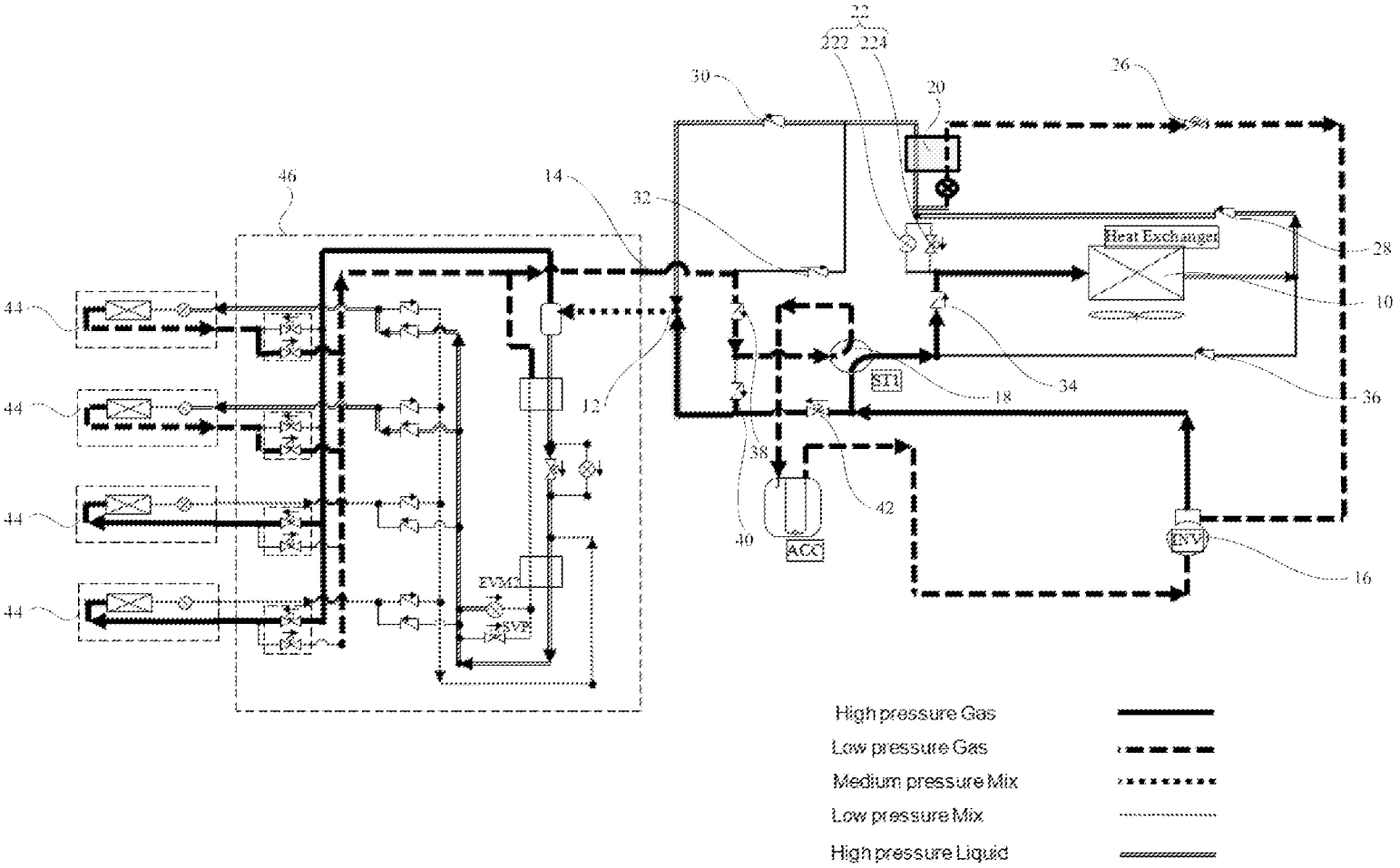
FIG. 5 illustrates a schematic view of a two-pipe enhanced-vapor-injection multi-split system in a main cooling mode provided by an embodiment of the present disclosure.
Figure 6:
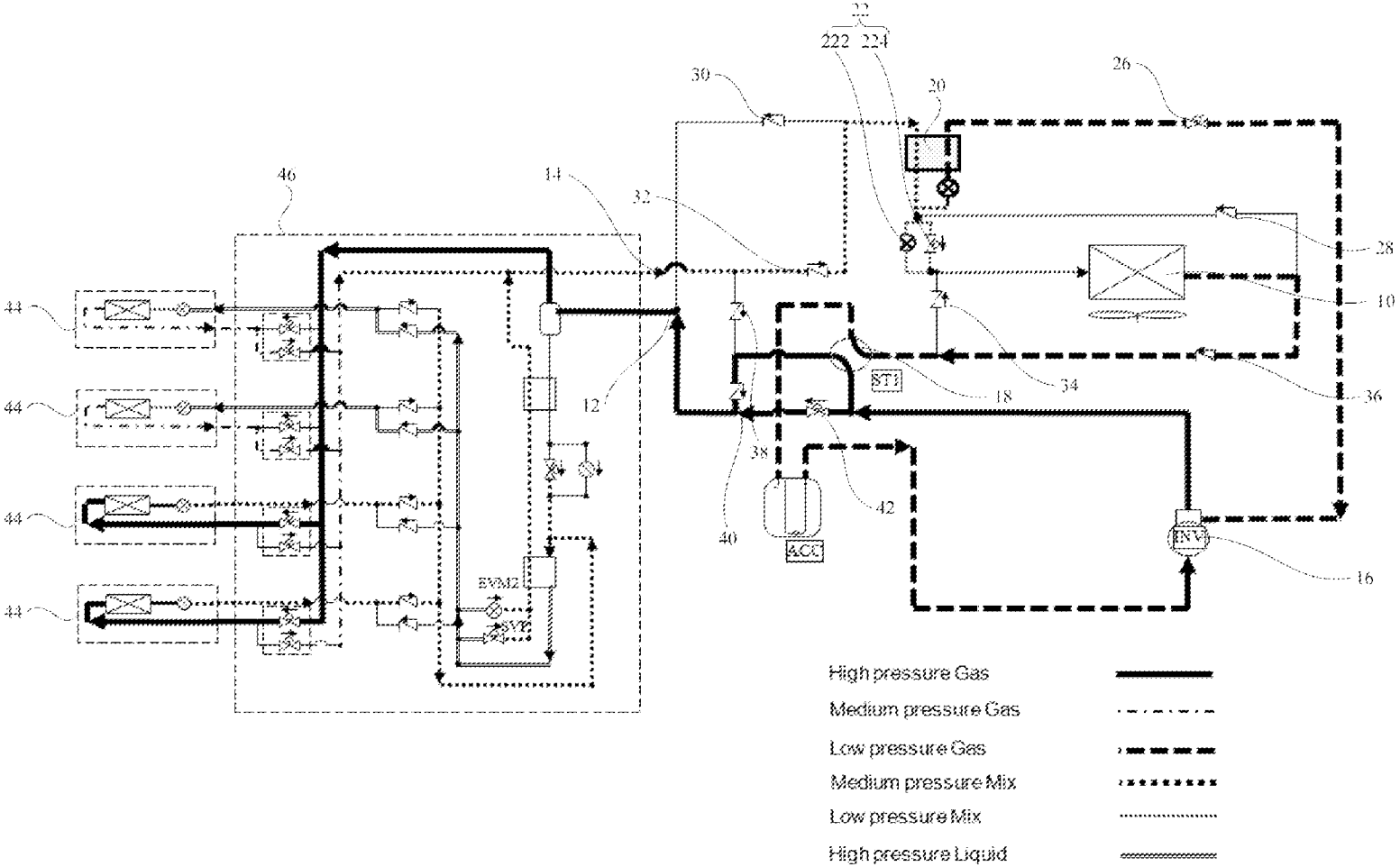
FIG. 6 illustrates a schematic view of a two-pipe enhanced-vapor-injection multi-split system in a main heating mode provided by an embodiment of the present disclosure.

FIG. 5 is a schematic view of the two-pipe enhanced-vapor-injection multi-split system in the main heating mode, in which the flow direction of the refrigerant in the pipeline is shown in the drawing. FIG. 6 is a schematic view of the two-pipe enhanced-vapor-injection multi-split system in the main cooling mode, in which the flow direction of the refrigerant in the pipeline is shown in the drawing.

In the description of the present specification, terms such as "up" and "down" indicate the orientation or position relationship based on the orientation or position relationship illustrated in the drawings only for convenience of description or for simplifying description of the present disclosure, and do not alone indicate or imply that the device or element referred to may have a particular orientation or be constructed and operated in a specific orientation, and hence cannot be construed as a limitation to the present disclosure. The terms "connected," "mounted," "fixed" should be understood broadly.

Reference throughout this specification to terms "one embodiment," "some embodiments," "a specific example," "an example" or "some examples," means that a particular feature, structure, material, or characteristic described in connection with the embodiment or example is included in at least one embodiment or example of the present disclosure. In this specification, exemplary descriptions of aforesaid terms are not necessarily referring to the same embodiment or example. Moreover, the particular features, structures, materials, or characteristics described may be combined in any suitable manner in one or more embodiments or examples.

What is claimed is:

1. A two-pipe enhanced-vapor-injection outdoor unit, comprising:

an outdoor heat exchanger, a first port and a second port;

an enhanced-vapor-injection compressor having a gas discharge port, a gas return port and an injection port;

a reversing assembly comprising a first end, a second end, a third end, and a fourth end, the first end of the reversing assembly being connected with the gas discharge port, the second end of the reversing assembly being connected with the gas return port, the first end being communicated with one of the third end and the fourth end, and the second end being communicated with the other one of the third end and the fourth end;

a super cooler comprising a main heat-exchange flow path and an auxiliary heat-exchange flow path communicated with each other, the main heat-exchange flow path being connected with the first port and the second port, and the auxiliary heat-exchange flow path being connected with the injection port directly;

a throttling assembly comprising a first end connected with an outlet of the main heat-exchange flow path, and a second end connected with an inlet of the outdoor heat exchanger; and a first pipe comprising a first end connected with an outlet of the outdoor heat exchanger, and a second end arranged between the throttling assembly and the main heat-exchange flow path.

2. The two-pipe enhanced-vapor-injection outdoor unit according to claim 1, wherein the third end of the reversing assembly is switchably connected to the inlet of the outdoor heat exchanger or the outlet of the outdoor heat exchanger, and the fourth end of the reversing assembly is switchably connected to the second port or the first port.

3. The two-pipe enhanced-vapor-injection outdoor unit according to claim 1, wherein an inlet of the main heat-exchange flow path is connected with the first port and the second port, an inlet of the auxiliary heat-exchange flow path is connected with the outlet of the main heat-exchange flow path, and an outlet of the auxiliary heat-exchange flow path is connected with the injection port.

4. The two-pipe enhanced-vapor-injection outdoor unit according to claim 1, wherein an inlet of the main heat-exchange flow path and an inlet of the auxiliary heat-exchange flow path are both connected with the first port and the second port, and an outlet of the auxiliary heat-exchange flow path is connected with the injection port.

5. The two-pipe enhanced-vapor-injection outdoor unit according to claim 1, wherein the two-pipe enhanced-vapor-injection outdoor unit comprises:

a first solenoid valve arranged between the auxiliary heat-exchange flow path and the injection port, and having a conduction direction from the auxiliary heat-exchange flow path to the injection port.

6. The two-pipe enhanced-vapor-injection outdoor unit according to claim 1, wherein the two-pipe enhanced-vapor-injection outdoor unit comprises:

a first check valve arranged in the first pipe, and having a conduction direction from the outlet of the outdoor heat exchanger to the throttling assembly.

7. The two-pipe enhanced-vapor-injection outdoor unit according to claim 6, wherein the two-pipe enhanced-vapor-injection outdoor unit comprises:

a second check valve connecting the first port with the main heat-exchange flow path, and having a conduction direction from the main heat-exchange flow path to the first port; and a third check valve connecting the second port with the main heat-exchange flow path, and having a conduction direction from the second port to the main heat-exchange flow path.

8. The two-pipe enhanced-vapor-injection outdoor unit according to claim 7, wherein the two-pipe enhanced-vapor-injection outdoor unit comprises:

a fourth check valve connecting the third end of the reversing assembly with the inlet of the outdoor heat exchanger, and having a conduction direction from the third end of the reversing assembly to the outdoor heat exchanger; and a fifth check valve connecting the third end of the reversing assembly with the outlet of the outdoor heat exchanger, and having a conduction direction from the outlet of the outdoor heat exchanger to the third end of the reversing assembly.

9. The two-pipe enhanced-vapor-injection outdoor unit according to claim 8, wherein the two-pipe enhanced-vapor-injection outdoor unit comprises:

a sixth check valve connecting the fourth end of the reversing assembly with the second port, and having a conduction direction from the second port to the fourth end of the reversing assembly; and a seventh check valve connecting the fourth end of the reversing assembly with the second port, and having a conduction direction form the fourth end of the reversing assembly to the second port.

10. The two-pipe enhanced-vapor-injection outdoor unit according to claim 5, wherein the two-pipe enhanced-vapor-injection outdoor unit comprises:

a second pipe connecting the gas discharge port with the first port; and a second solenoid valve arranged in the second pipe, and having a conduction direction from the gas discharge port to the first port.

11. The two-pipe enhanced-vapor-injection outdoor unit according to claim 9, wherein the throttling assembly comprises at least one throttling device and at least one eighth check valve, and the eighth check valve has a conduction direction from the super cooler to the inlet of the outdoor heat exchanger.

12. A two-pipe enhanced-vapor-injection multi-split system, comprising:

a two-pipe enhanced-vapor-injection outdoor unit, comprising:

an outdoor heat exchanger, a first port and a second port;

an enhanced-vapor-injection compressor having a gas discharge port, a gas return port and an injection port;

a reversing assembly comprising a first end, a second end, a third end, and a fourth end, the first end of the reversing assembly being connected with the gas discharge port, the second end of the reversing assembly being connected with the gas return port, the first end being communicated with one of the third end and the fourth end, and the second end being communicated with the other one of the third end and the fourth end;

a super cooler comprising a main heat-exchange flow path and an auxiliary heat-exchange flow path communicated with each other, the main heat-exchange flow path being connected with the first port and the second port, and the auxiliary heat-exchange flow path being connected with the injection port directly;

a throttling assembly comprising a first end connected with an outlet of the main heat-exchange flow path, and a second end connected with an inlet of the outdoor heat exchanger; and a first pipe comprising a first end connected with an outlet of the outdoor heat exchanger, and a second end arranged between the throttling assembly and the main heat-exchange flow path.

* * * * *